US007536254B2

(12) United States Patent
Kumagai et al.

(10) Patent No.: US 7,536,254 B2
(45) Date of Patent: May 19, 2009

(54) TRAFFIC INFORMATION ESTIMATING SYSTEM

(75) Inventors: Masatoshi Kumagai, Hitachi (JP); Takumi Fushiki, Paris (FR); Takayoshi Yokota, Hitachioota (JP); Kazuya Kimita, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 433 days.

(21) Appl. No.: 11/356,221

(22) Filed: Feb. 17, 2006

(65) Prior Publication Data

US 2006/0206256 A1 Sep. 14, 2006

(30) Foreign Application Priority Data

Mar. 9, 2005 (JP) ..... 2005-064767

(51) Int. Cl.
*G08G 1/00* (2006.01)

(52) U.S. Cl. ..... 701/117; 340/934; 340/995.13

(58) Field of Classification Search ..... 701/117–119
See application file for complete search history.

(56) References Cited

U.S. PATENT DOCUMENTS

| | | | | |
|---|---|---|---|---|
| 3,239,653 | A * | 3/1966 | Barker | 701/118 |
| 3,239,805 | A * | 3/1966 | Brockett | 340/934 |
| 3,389,244 | A * | 6/1968 | Brockett | 701/118 |
| 5,173,691 | A * | 12/1992 | Sumner | 340/905 |
| 5,182,555 | A * | 1/1993 | Sumner | 340/905 |
| 5,812,069 | A * | 9/1998 | Albrecht et al. | 340/905 |
| 5,822,712 | A * | 10/1998 | Olsson | 701/117 |
| 6,222,836 | B1 * | 4/2001 | Sekiyama et al. | 370/351 |
| 6,462,697 | B1 * | 10/2002 | Klamer et al. | 342/36 |
| 6,466,862 | B1 * | 10/2002 | DeKock et al. | 701/117 |
| 6,574,548 | B2 * | 6/2003 | DeKock et al. | 701/117 |
| 6,785,606 | B2 * | 8/2004 | DeKock et al. | 701/117 |
| 6,882,930 | B2 * | 4/2005 | Trayford et al. | 701/117 |

(Continued)

FOREIGN PATENT DOCUMENTS

GB 2 424 111 B 11/2007

(Continued)

OTHER PUBLICATIONS

GB Combined Search and Examination Report dated Jun. 14, 2006 (Seven (7) pages).

(Continued)

*Primary Examiner*—Khoi Tran
*Assistant Examiner*—Shelley Chen
(74) *Attorney, Agent, or Firm*—Crowell & Moring LLP

(57) ABSTRACT

A traffic information system includes: a past information database for storing past information, which is collected for road links in a predetermined area, of a past mobile object on a road; a current information database for storing running information, which is collected for the road links in the predetermined area, of a current mobile object; link correlation analyzing means in which correlations of traffic information among each road link in the predetermined area are calculated from the past information stored in the past information database, and output as link correlation information among the road links; combination calculating means for calculating weighting information for obtaining the current information as a sum of the link correlation information; and traffic information estimating means for calculating estimated traffic information for a link where the current information is not collected based on the link correlation information and the weighting information.

6 Claims, 8 Drawing Sheets

U.S. PATENT DOCUMENTS

| | | | | |
|---|---|---|---|---|
| 7,143,442 | B2 * | 11/2006 | Scarfe et al. | 726/23 |
| 7,167,795 | B2 * | 1/2007 | Hirose et al. | 701/210 |
| 2002/0193938 | A1 * | 12/2002 | DeKock et al. | 701/117 |
| 2003/0073406 | A1 * | 4/2003 | Benjamin et al. | 455/41 |
| 2003/0225516 | A1 * | 12/2003 | DeKock et al. | 701/214 |
| 2004/0103021 | A1 * | 5/2004 | Scarfe et al. | 705/13 |
| 2005/0222755 | A1 * | 10/2005 | Tengler et al. | 701/201 |
| 2006/0025925 | A1 * | 2/2006 | Fushiki et al. | 701/210 |
| 2006/0058940 | A1 * | 3/2006 | Kumagai et al. | 701/117 |
| 2006/0064234 | A1 * | 3/2006 | Kumagai et al. | 701/117 |
| 2006/0206256 | A1 * | 9/2006 | Kumagai et al. | 701/117 |
| 2006/0242610 | A1 * | 10/2006 | Aggarwal | 716/1 |
| 2007/0208493 | A1 * | 9/2007 | Downs et al. | 701/117 |
| 2007/0208494 | A1 * | 9/2007 | Chapman et al. | 701/117 |
| 2007/0208495 | A1 * | 9/2007 | Chapman et al. | 701/117 |
| 2007/0208496 | A1 * | 9/2007 | Downs et al. | 701/117 |
| 2007/0208501 | A1 * | 9/2007 | Downs et al. | 701/119 |
| 2008/0030371 | A1 * | 2/2008 | Kumagai et al. | 340/905 |
| 2008/0046165 | A1 * | 2/2008 | Downs et al. | 701/117 |
| 2008/0071465 | A1 * | 3/2008 | Chapman et al. | 701/117 |
| 2008/0114529 | A1 * | 5/2008 | Hiruta et al. | 701/117 |

FOREIGN PATENT DOCUMENTS

| | | | |
|---|---|---|---|
| JP | 129893 | | 5/1995 |
| JP | 8-313285 | A | 11/1996 |
| JP | 2004-318621 | A | 11/2004 |
| JP | 2005-30876 | A | 2/2005 |
| WO | WO 94/11839 | A1 | 5/1994 |

OTHER PUBLICATIONS

Corresponding British Office Action dated May 16, 2007 (five (5) pages).
Corresponding British Office Action (Notification of Grant: Patent Serial No. GB 2424111) dated Oct. 23, 2007 (two (2) pages).
Certificate of Grant of Patent for GB 2424111 (three (3) pages).

* cited by examiner

TRAFFIC INFORMATION ESTIMATING SYSTEM

CROSS REFERENCE TO RELATED APPLICATIONS

This application claims the foreign priority benefit under Title 35, United States Code, §119(a)-(d) of Japanese Patent Applications No. 2005-064767, filed on Mar. 9, 2005, the contents of which are hereby incorporated by reference.

BACKGROUND OF THE INVENTION

1. Field of the Invention

The present invention relates to a system for estimating traffic information of a road link where data is not collected by a probe car.

2. Description of Revelant Art

A probe car system can collect wider traffic information with a lower cost compared with, such as, VICS (Vehicle Information and Communication System) which collects the traffic information by on-road sensors. However, since a running position and running timing of the probe car are probabilistic, space and time missings occur in a data series of collected probe traffic information. For example, if we focus on time-series data of the traffic information in one road link, since the probe car may be running in some case and may be not in other case depending on a time, the time-series data of the collected traffic information frequently contains a missing value. In addition, if we focus on a plurality of road links at a certain moment, since the probe car may be running in some road link (road link where the traffic information is collected) and may be not in other link (road link where the traffic information is not collected), a spatial data series also contains a missing value. For example, in the application for providing with information to a car navigation system or a path search, if there is a missing in the traffic information, correct processing of the information is difficult. Therefore, it is requested to provide with some estimated information to the link where the traffic information is missing if the traffic information is used for the above application.

A method for estimating the traffic information of another road link from that of collected by on-road sensors, such as VICS, is disclosed, for example, in Japanese Laid-Open Patent Application Number 7-129893. This method estimates the traffic information of a link where the traffic information is missing from upstream and downstream links, or from the traffic information of a link which is parallel to the link, based on a connection relation of the road link. On the other hand, a statistical usage of the probe traffic information is described in a non-patent document, "A NEW INFORMATION PROVIDING SYSTEM EXPAMDING POSSIBILITY OF CAR NAVIGATION" (Tsuge, et al.), "JIDOSHA GIJUTSU" (Car Technologies), Vol. 58, No. 2, pp 44-48, 2004/2, as an estimation method which uses only the probe traffic information, without depending on the connection relation of the road link. This method stores the probe traffic information after processing it into traffic information in conformity with VICS regulations, and provides with current traffic information when the current traffic information is collected, or past traffic information, which has been statistically processed, instead of the current traffic information when the current traffic information is not collected. Other than the above, for example, there is a method for continuing providing past probe traffic information until the probe traffic information is updated as a simple estimation method.

However, there are following problems in these conventional estimation technologies. For one thing, when a percentage of missing values (missing percentage) occupying within a data series of the probe traffic information is high, an estimation based on the connection relation of the traffic link is difficult. The missing percentage, when it is a missing percentage of time, is a ratio of a number of times which could not collect the probe traffic information during an update period to a number of update times of the probe traffic information per day for a road link. Also, a spatial missing percentage is a ratio of a number of road links which could not collect the probe traffic information during the update period of the probe traffic information to a number of total road links included in a control unit (for example, a unit of map mesh) of the probe traffic information. For example, even if one hundred thousand probe cars are prepared throughout Japan, a number of update frequencies of the probe traffic information will be one time per hour in average for one road link. If we try to use the probe traffic information at every five minutes as the traffic information, which is almost the same condition with the VICS, the spatial missing percentage will be over 90%. Therefore, when an estimation of the traffic information of some road link is intended by using neighbor road links, it frequently happens that the traffic information of the neighbor road links is entirely missing. In addition, if the estimation is implemented based on the connection relation with distant road links, the estimation accuracy is rapidly decreased, thereby resulting in large discrepancy between the estimated information and a current traffic status. On the other hand, if the past probe traffic information is utilized statistically, the estimation is possible even if the missing percentage of the probe traffic information is high. However, the probe traffic information, which has been statistically processed, does not always indicate the current status.

It is, therefore, an object of the present invention to provide a traffic information system which accurately reflects current probe traffic information, which is collected from another road link, in an estimation of traffic information of a road link where the current probe traffic information is not collected, when the probe traffic information with high missing percentage is utilized.

SUMMARY OF THE INVENTION

A traffic information component, which varies with correlations among a plurality of road links, is calculated as a base of the traffic information of a link group of the road links by implementing a Principal Component Analysis for probe traffic information collected in the past. In addition, a weighting coefficient of each base of current probe traffic information in the link group is calculated by projection of the current probe traffic information to the each base. Estimated traffic information in the link group is calculated by a linear sum of the each base, using the weighting coefficient as a coefficient of the each base. If a link is missing of the current probe traffic information, the estimated traffic information is provided to the link instead of the current traffic information.

Therefore, the traffic information in a road link, where the current probe traffic information is not collected, can be estimated accurately from the current traffic information, which is collected in another road link based on correlations of the traffic information among the road links, by using the probe traffic information stored in the past, without depending on a connection relation of the road link.

DETAILED DESCRIPTION OF THE PREFERRED EMBODIMENT

Hereinafter, a configuration of an unit according to the present invention will be explained. The unit is such that, by calculating correlations of traffic information among road links from probe traffic information stored in the past, and based on the correlations, the traffic information of a road link where current probe traffic information is not collected is estimated from the current probe traffic information which is collected from another road link, and then, the estimated traffic information is provided to the link instead of the current probe traffic information.

First Embodiment

Figure 1:
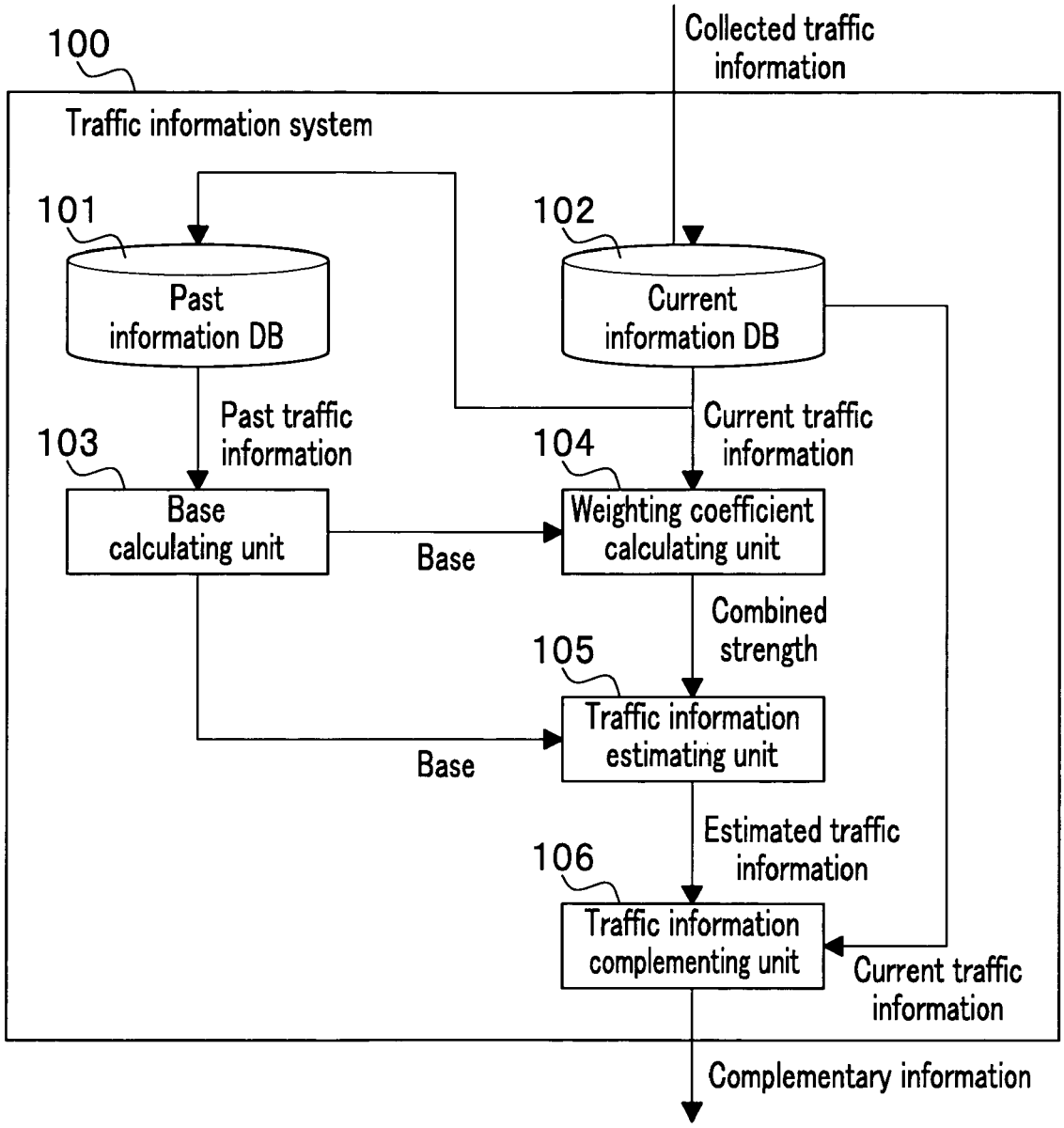
FIG. 1 is a block diagram of a system for producing estimated traffic information based on probe traffic information.

FIG. 1 is a block diagram of a traffic information system 100, which complements traffic information of a road link where probe traffic information is not collected, according to the present invention. A current information database 102 is a database (hereinafter, referred to as DB) which stores traffic information collected by, for example, a taxi, a bus, and a private car as current probe traffic information. The current information database 102 stores car information (such as, a time, a running speed, a coordinate of a running position) which is sent from a probe car by dividing the information into each road link corresponding to the running position of the car, and updates it at every measurement interval. A past information DB 101 is a database which stores past probe traffic information. The probe traffic information stored in the past information DB 101 is the traffic information collected as the current traffic information in the past. A timing for storing the current probe information in the past information DB 101 can be set arbitrarily, for example, at every update cycle of the current probe traffic information, or at every one hour, every day, and every week after tallying up the current traffic information at every update cycle.

A base calculating unit 103 implements a Principal Component Analysis for the past probe traffic information in a plurality of road links (hereinafter, referred to as link group), and outputs traffic information components, which vary with correlations among the plurality of the road links for an analysis target, as bases of the link group. Typical traffic information as an analysis target is, for example, a traveling time of a link, and also, may be an average speed and a degree of traffic jams. A period for processing of the base calculating unit 103 is arbitrary, for example, at every day or at every week. The shorter the period is, for example, the more promptly road structure changes and seasonal variations can be reflected on the bases. A time span of the past traffic information for calculating the bases is arbitrary. However, one week traffic information is requested for producing the bases which reflect variations by day in a week. Further, if the traffic information is limited to one week, when unusual traffic jams due to, for example, accidents and constructions happens during the week, the bases are strongly effected by it. Therefore, the bases are produced by storing the traffic information for two weeks to one month for reducing the above effect.

In a base calculating unit 103, one sample of analysis target data is the probe traffic information which is collected at the same timing about road links existing in an analysis target area. The analysis target area is composed of a unit of a map mesh in general. However, it also may be, for example, an administrative area or a vicinity of a main road, that is, it is not limited by a shape of the area, provided that the road link for the analysis can be identified. A number of road links of the analysis target corresponds to a number of variables of one sample. That is, the probe traffic information collected at N collection timings for M road links in the past is data of N samples and M variables. If the Principal Component Analysis is implemented for the data, P (P<<M) pieces of the bases are obtained. These bases obtained by Principal Component Analysis have a property of approximating an arbitrary sample of original data by a linear sum of the bases. In addition, each base is configured with M elements corresponding to each variable of the original data, and configuration elements of one base are components which vary with correlations among each variable of the original data. That is, if traffic information X(n) of links 1 to M at a collection timing n is assumed to be a vector configured with traffic information x(n, m) in each link m, $$X(n)=[x(n,1),x(n,2),\ldots,x(n,M)] \tag{1}$$

and if the p-th base W(p) is expressed with a vector of an element w(p, m) of the base in the link m, $$W(p)=[W(p,1),W(p,2),\ldots,W(p,M)] \tag{2}$$

Then, $$X(n)\cong a(n,1)\times W(1)+a(n,2)\times W(2)+\ldots+a(n,P)\times W(P) \tag{3}$$

Here, a(n, p) is a weighting coefficient of the p-th base in a linear sum of the bases at the collection timing n. In this embodiment, the property of Principal Component Analysis indicates that traffic information at an arbitrary timing in the link group of a Principal Component Analysis target can be approximately expressed by a linear sum of the bases. Meanwhile, usual Principal Component Analysis does not allow a missing in data of the analysis target. However, by using an extended Principal Component Analysis, "Principal Component Analysis with Missing Data (PCAMD)", the bases can be calculated from the probe traffic information with missing data.

Figure 7:
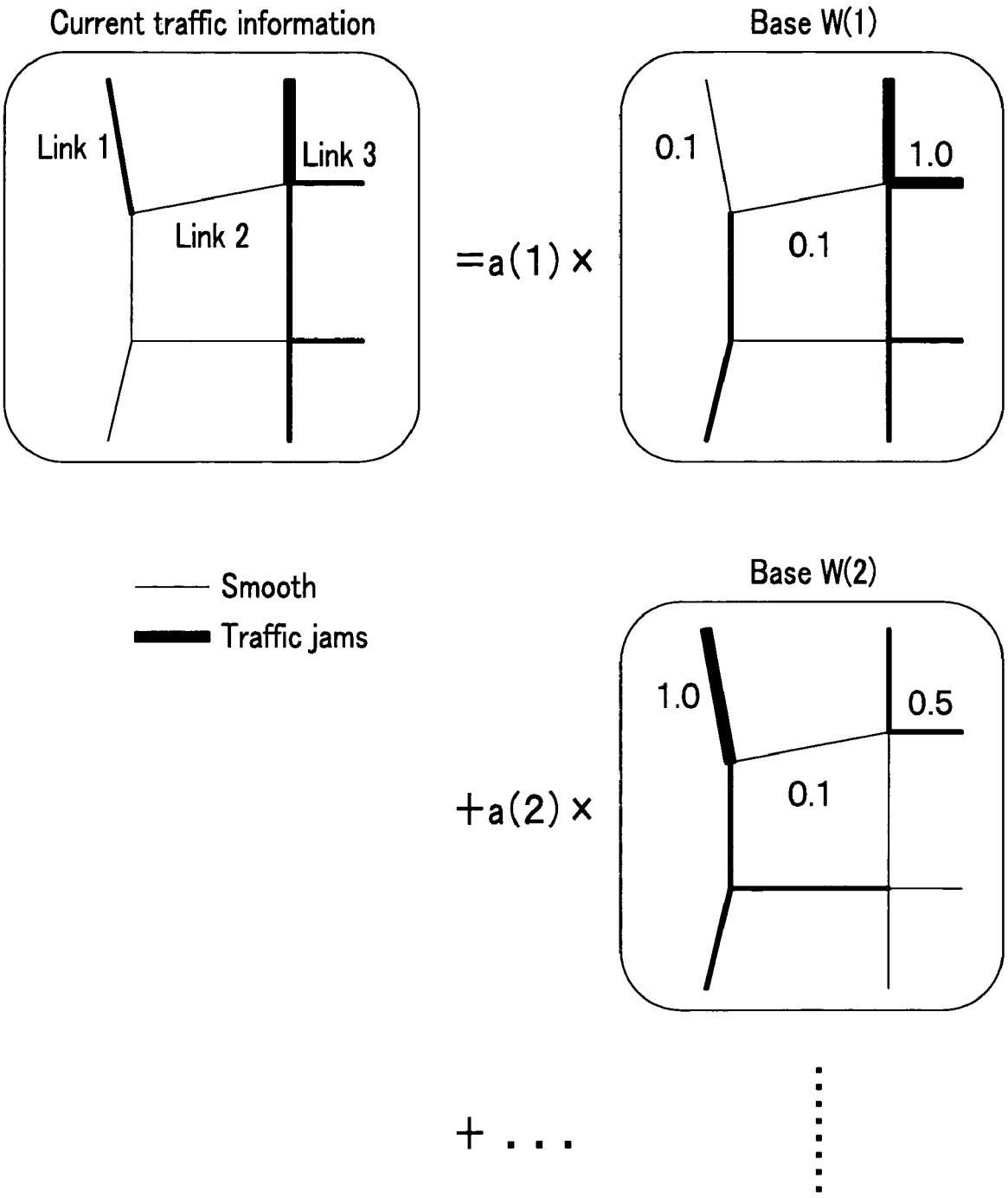
FIG. 7 is a diagram for expressing traffic information with a plurality of bases.

If an analysis process by the base calculating unit is expressed with a diagram, it will be as FIG. 7. Meanwhile, in FIG. 7, since the explanation is limited to the current probe traffic information, the collection timing is 1. Then, a weighting coefficient for the p-th base W(p) is expressed as a(p). In FIG. 7, a left-hand side of an equal mark expresses a value of current traffic information with a line thickness in a plurality of road links of the analysis target. The right-hand side of the equal mark expresses the value of the traffic information with a linear sum of a plurality of bases. In the right-hand side, each base is configured with traffic information components which vary with correlations among each link, and a coefficient of each base changes with no correlation to each other. By expressing the traffic information like this, a trend of the traffic status in a plurality of links can be expressed with a value of the coefficient of each base.

For example, if the components of link 1, link 2, and link 3 in base W(1) are assumed as [0.1, 0.1, 1.0], this means that the components which vary with a ratio of 1:1:10 are included in the traffic information of the links 1 to 3. On the other hand, if each component of the links 1 to 3 in base W(2) is [1.0, 0.1, 0.5], this means that the each component varying with a ratio of 10:1:5 is also included in the traffic information, as well as the ratio of 1:1:10. Then, trends of the traffic information in the links 1 to 3 can be expressed such as, "The link 3 is in a heavy traffic jam, compared with the link 1 and the link 2" and "When the link 1 is in a traffic jam, the link 2 is nearly empty and the link 3 is a little crowded with cars", by the weighting coefficient (coefficient a(1) of base W(1)) of the component varying with 1:1:10 and the weighting coefficient (coefficient a(2) of base W(2)) of the component varying with 10:1:5. As described above, a Principal Component Analysis is suitable for obtaining these bases by analyzing the past traffic information. However, such as an Independent Component Analysis and a Factor Analysis are also applicable to the analysis, and a statistical method which can apply to base calculating unit 103 is not limited to the Principal Component Analysis.

Since a purpose of processing of the base calculating unit is to digitize correlations of the traffic information among the links as bases like the above, it is requested to assign a link group varying with correlations on a practical road network as an analysis unit. Therefore, a method which assigns traffic information of links in the same mesh as the analysis unit of the aforementioned Principal Component Analysis, and a method which assigns the traffic information of the links along an arterial road as the analysis unit, are applicable to the purpose, and a selection method of the link group of the analysis target is not limited to one.

A weighting coefficient calculating unit 104 calculates a weighting coefficient of each base, which is obtained by the base calculating unit 103, for the current probe traffic information. The weighting coefficient of each base is obtained by implementing weighting projection of the current probe traffic information to a linear space spanned with the vectors W(1) to W(p) of the bases. The weighting projection is a mathematical method for changing a scale by each coordinate axis in the projection of the linear space. Here, the weighting projection is used in setting a link which should be weighted heavily for determining a base strength which is occupied in the current traffic information. For example, for the bases W(1) and W(2) in FIG. 7, when the current traffic information of the links 1 to 3 are [5, 1, 10], if the link 1 and the link 2 are weighted heavily, it is supposed that the link 1 is crowded and the link 2 is empty, then, the strength of the base W(2) is evaluated to be relatively strong. On the other hand, if the link 3 is weighted heavily, since the link 3 is crowded compared with the link 1 and the link 2, the strength of base the W(1) is evaluated to be relatively strong. If a link which is measured information such as the probe traffic information, and a link which is missing of the information are clearly distinguished, a weighting coefficient of the former link is set to be "1" (one) and that of the latter link is set to be "0" (zero) for determining each base strength which is occupied in the current traffic information.

The above processing is expressed by the following formulas. The current probe traffic information Z of the links 1 to M is assumed to be a vector configured with traffic information z(m) at each link m, as with formula (1)

$$Z=[z(1),z(2),\ldots,z(M)] \tag{4}$$

Next, the weighting projection of Z to W(1) to W(p) is implemented with weighting coefficients "1" for a link where the probe traffic information is collected, and "0" for a link where the probe traffic information is not collected, of the traffic information z(1) to z(M) in the links 1 to M.

$$Z=\alpha(1)\times W(1)+\alpha(2)\times W(2)+\ldots+\alpha(P)\times W(P)+e \tag{5}$$

Then, in the formula (5), the α(1) to α(P) which minimize a norm of an error vector "e" can be obtained for the link where the probe traffic information is collected. Weighting coefficient calculating unit 104 outputs the α(1) to α(P) as weighting coefficients of the current probe traffic information. Meanwhile, the weighting coefficient is not limited to two values "1" and "0", but also multi values or a continuous value may be available depending on a reliability and freshness of the collected probe traffic information. For example, the reliability of the probe traffic information in each road link generally increases in proportion to a number of the probe cars passing through the link. Therefore, if the weighting coefficient is designed to be a function proportional to the number of the probe cars, the weighting coefficients α(1) to α(P) of the bases can be determined by weighting heavily the road link where is highly reliable. The function is, for example, such as a formula (6), where the weight of a link is F, and the number of probe cars passing through the link in unit time is c.

$$F(c)=\exp(c)-1 \tag{6}$$

Other than the above, it may be possible to change the weighting coefficient for a discrete range, for example, if $1\leqq c<5$, then F=1.0, and if $5\leqq c<10$, then F=1.5. In addition, when the current probe traffic information is measured with a given time span, if the weighting coefficient of a link is designed to be larger according to the freshness of the information, the weighting coefficient can be determined by weighting heavily the latest information as well as using the old information within the given time span. A function described in the above will be, for example, as follows by using a time difference "τ" between the collecting time of the probe traffic information and the current time.

$$F(\tau)=\exp(-\tau) \tag{7}$$

Other than the above, it may be possible to change the weighting coefficient for a discrete range, such as, if $0\leqq\tau<10$, then F=1.0, if $10\leqq\tau<20$, then F=0.5, and if $20\leqq\tau$, then F=0.0.

A traffic information estimating unit 105 calculates estimated traffic information based on the base obtained by the base calculating unit 103 and the weighting coefficient obtained by the weighting coefficient calculating unit 104. An estimated traffic information vector Z' of the links 1 to M is expressed as a vector configured with estimated traffic information z' (m) in each link m, and calculated from the base vectors W(1) to W(p) and the weighting coefficients α(1) to α(P) for each base.

$$Z'=[z'(1),z'(2),\ldots,z'(M)] \tag{8}$$

$$Z'=\alpha(1)\times W(1)+\alpha(2)\times W(2)+\ldots+\alpha(P)\times W(P) \tag{9}$$

A relation between the current probe traffic information vector Z and the estimated traffic information vector Z' is that z'

(i) in a link i where the current probe traffic information is collected is an approximated value of the z(i), and that z' (j) at link j where the current probe traffic information is not collected is an estimated value of the z(j). A traffic information complementing unit 106 outputs the estimated traffic information z' (j) for a link j where the current traffic information is not collected, that is, for the link which is missing of the traffic information, by comparing the current prove traffic information Z and the estimated traffic information Z' which is output from the traffic information estimating unit 105.

Figure 8:
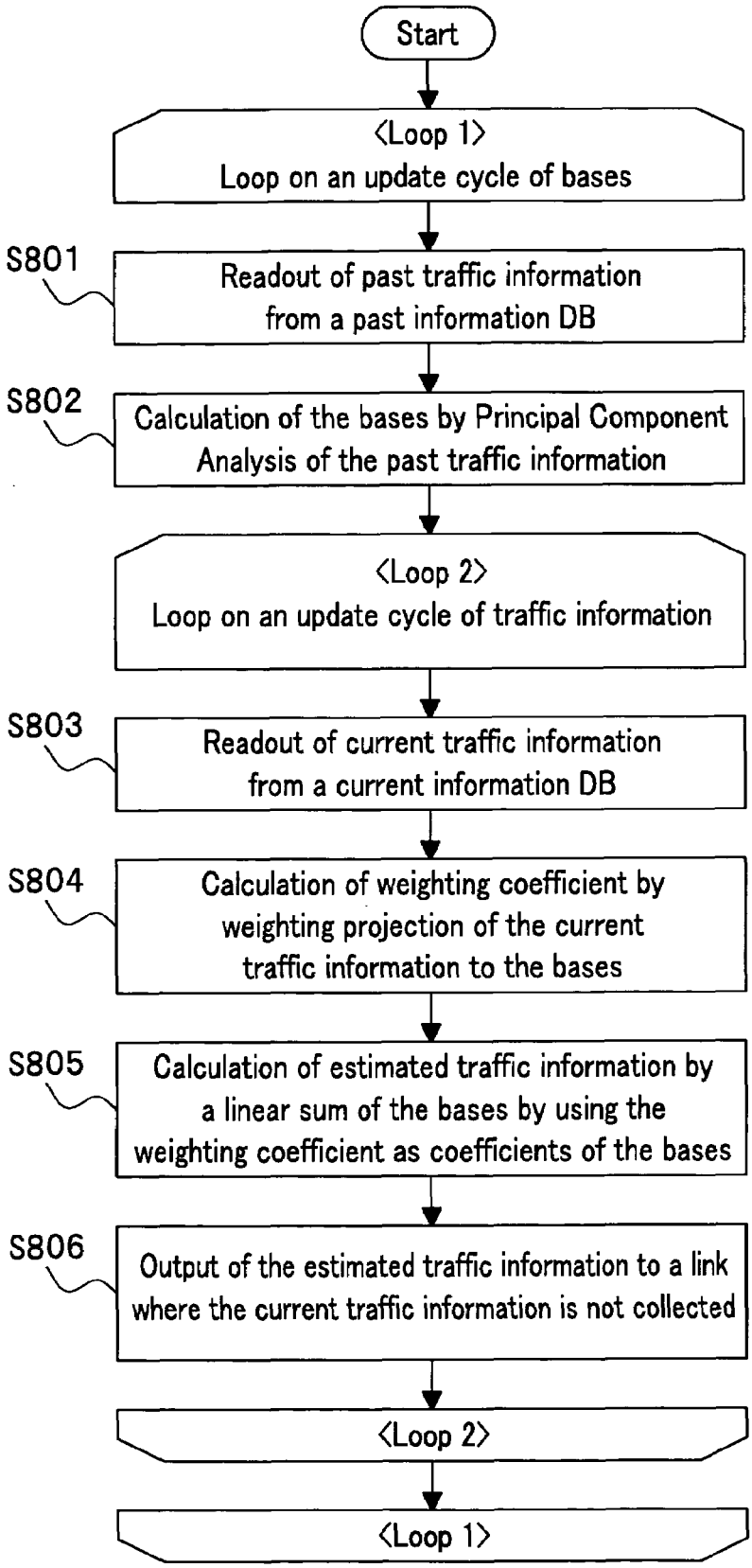
FIG. 8 is a processing flow diagram of a system for producing estimated traffic information based on probe traffic information.

FIG. 8 is a flow diagram of processing in the configuration in FIG. 1 described in the above. Step 801 (Hereinafter, step 801 is described as S801. Other steps are also described similar to this) is processing for reading out past probe traffic information from the past information DB 101. A target time span of the reading out is arbitrarily determined, for example, to be at every one week or at every one month depending on the aforementioned effects which are reflected on the bases, such as, road structure changes, seasonal variations, and variations by day in a week, or the effects due to unusual traffic jams caused by accidents and constructions. In addition, the read out traffic information corresponds to the estimated traffic information estimated by the traffic information estimating unit 105. Since a link traveling time through a link and an average speed in the link are compatible to each other using a link length, and since a degree of traffic jam can be approximated from the average speed in the link, the link traveling time is here used as a representative parameter. S802 is processing of the base calculating unit 103 for implementing Principal Component Analysis for the read out probe traffic information. The bases W(1) to W(p) in the analysis target area are produced through the processing. The processing of S801 and S802 is implemented within a Loop 1. The Loop 1 is a loop which is implemented at every update cycle of the bases, for example, at one time per day or at one time per week. On the other hand, a Loop 2 is processing implemented at every collecting timing or at every providing timing of the current probe traffic information. In the Loop 2, first, the current traffic information through the probe traffic information, which is collected between the collecting cycles or providing cycles of the traffic information, is read out from the current DB 120 at S803. Next, at S804, the weighting coefficients $\alpha(1)$ to $\alpha(P)$ for the current probe traffic information are calculated by implementing the weighting projection, which is processing of the weighting coefficient calculating unit 104. At S805, the estimated traffic information is calculated based on the bases W(1) to W(p), which are calculated at S802, and the weighting coefficients $\alpha(1)$ to $\alpha(P)$, which are calculated at S804. The above processing is implemented by the traffic information estimating unit 105. Finally, the estimated traffic information which is calculated at S805 is output to a link where the current traffic information is not collected (a link where the traffic information is missing) by the traffic information complementing unit 106 at S806. S803 to S806 are implemented at 5 minutes cycle if the traffic information is provided, for example, at 5 minutes cycle.

In the aforementioned configuration in FIG. 1, data to be stored in the past information DB and the current information DB is not limited to the traffic information collected by a probe car. Traffic information collected by on-road sensors is also usable as constant and high reliable information, as well as the traffic information collected by the probe car.

Second Embodiment

Figure 2:
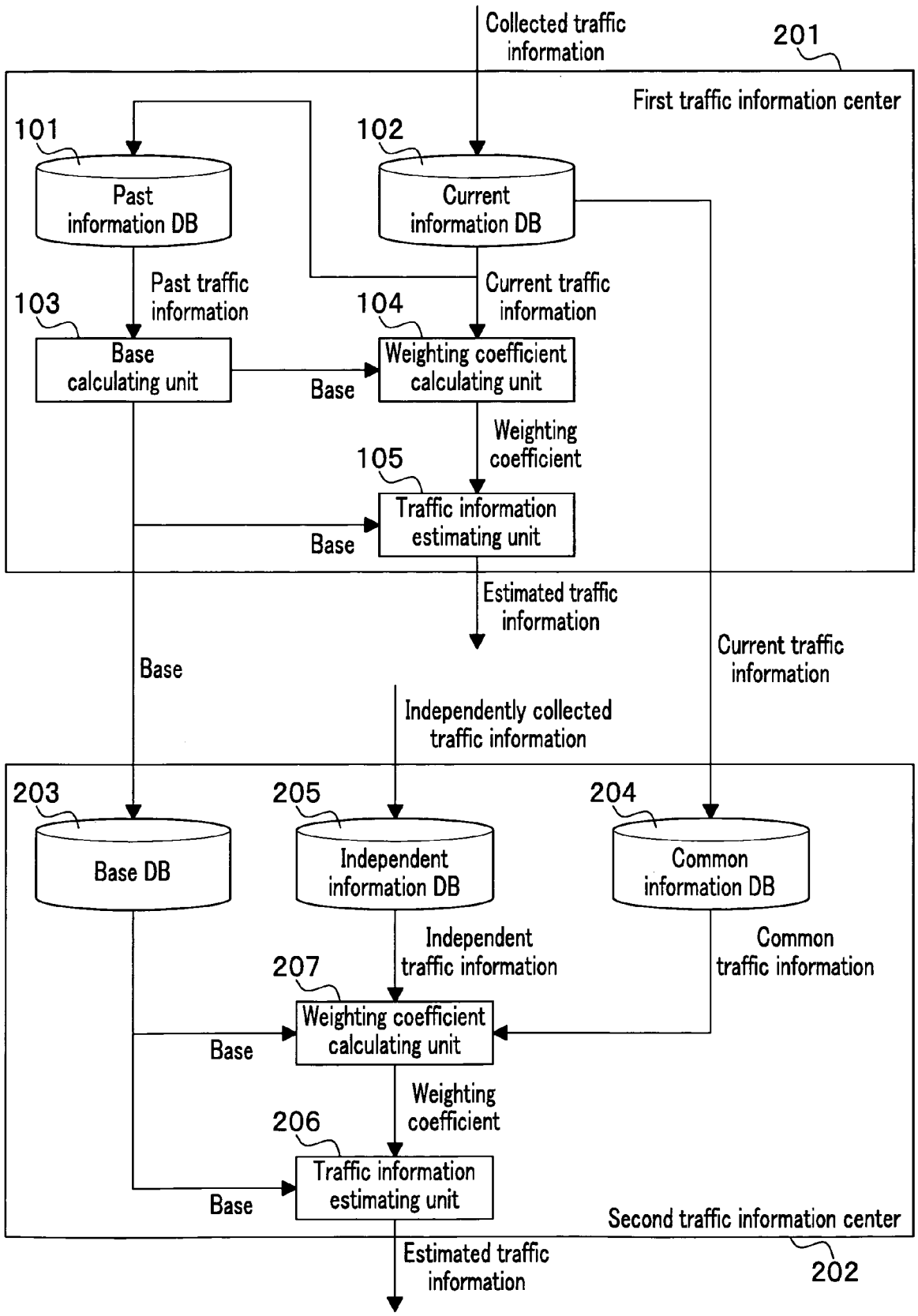
FIG. 2 is a block diagram of a traffic information system configured with a plurality of traffic information centers.

FIG. 2 is a block diagram showing a configuration in which functions from the past information DB 101 to the traffic information estimating unit 105 for providing with estimated traffic information, out of traffic information system 100 shown in FIG. 1, are installed in a plurality of traffic information centers by separating the functions from the traffic information system 100. A first traffic information center 201 is a traffic information center which has a public property shared by a car maker, a navigator maker, a contents provider, and a government, and includes the past information DB 101, the current information DB 102, the base calculating unit 103, the weighting coefficient calculating unit 104, and the traffic information estimating unit 105 in FIG. 1. The first traffic information center 201 delivers current probe traffic information (common probe traffic information) and estimated traffic information calculated by the traffic information estimating unit 105 to the outside, as well as delivering bases output from the base calculating unit 103 to a second traffic information center 202. Meanwhile, if a delivery of the estimated traffic information is not conducted at the first traffic information center 201, the weighting coefficient calculating unit 104 and the traffic information estimating unit 105 are not essential to the first traffic information center 201.

The second traffic information center 202 is a traffic information center which handles probe traffic information independently collected by, for example, a car maker and a navigator maker for their users, and has a property for serving to a club member. The second traffic information center 202 includes a weighting coefficient calculating unit 207 and a traffic information estimating unit 206, which are similar to those of the first traffic information center 201, and stores bases in a base DB 203 by receiving the bases from the first traffic information center 201. The current traffic information received from the first traffic information center 201 is stored in a common information DB 204. On the other hand, the current probe traffic information (independent probe traffic information) which is collected by the second traffic information center with its own probe cars is stored in an independent information DB 205.

When the second traffic information center 202 produces the estimated traffic information, the center 202 first calculates a weighting coefficient of each base of the current probe traffic information by a weighting coefficient calculating unit 207 based on the bases stored in the base DB 203, the traffic information, which is stored in the common information DB 204, received from the first traffic information center 201, and the independent probe traffic information stored in the independent information DB 205. This processing is executed by a similar manner to the first embodiment by implementing the weighting projection of probe traffic information S, which is produced by merging the common probe traffic information Z (formula (4)) and independent probe traffic information R, onto a linear space spanned with the base vectors W(1) to W(p).

Here, the independent probe traffic information R and the merged probe traffic information S are expressed in the following formulas respectively, as vectors of traffic information r(m) and s(m) in each link m.

$$R=[r(1),r(2),\ldots,r(M)] \tag{10}$$

$$S=[s(1),s(2),\ldots,s(M)] \tag{11}$$

In a link where only the common probe traffic information is collected, s(i)=z (i), and in a link where only the independent probe traffic information is collected, s (j)=r(j). In addition, in a link k where both of the common and independent probe traffic information are collected, s(k) is an average or weighted average of z(k) and r(k). A basic method for the weighting projection in this case is such that the weighting at a link where the current probe traffic information is collected is "1", and that of where the current probe traffic information is not collected is "0" (zero) regardless of whether the information is the common probe traffic information or the independent probe traffic information. However, it is no matter to change the weighting, for example, by weighting more heavily the probe traffic information which is collected independently. For example, the weighting of the independent probe traffic information is "1", and that of the common probe traffic information is "0.5". The processing for calculating the estimated traffic information by the traffic information estimating unit 206 based on the weighting coefficients obtained through the processing of the weighting coefficient calculating unit 207 and the bases stored in base DB 203 is similar to that of the first embodiment.

In the second embodiment, as described above, the first traffic information center 201 and the second traffic information center 202 produce the estimated traffic information based on the common probe traffic information and the independent probe traffic information, respectively. The first traffic information center 201 provides with the estimated traffic information, using information within the common probe traffic information. On the other hand, the second traffic information center 202 can provide with more accurate estimated traffic information to users by using the independent probe traffic information in addition to the common probe traffic information in calculating the weighting coefficient, as well as making use of the bases in common with the first traffic information center 201.

Meanwhile, when, for example, the probe traffic information which is used at the first traffic information center 201 is collected through information sources which have no relation with individual information, such as, a bus, a taxi, and a truck, and the probe traffic information used at the second traffic information center 202 is collected through a private car, the configuration described above is effective for producing accurate estimated traffic information as accurate as possible at both traffic information centers, while limiting the processing of the individual information, such as latitude and longitude information of the car, within the second traffic information center 202.

Third Embodiment

Figure 3:
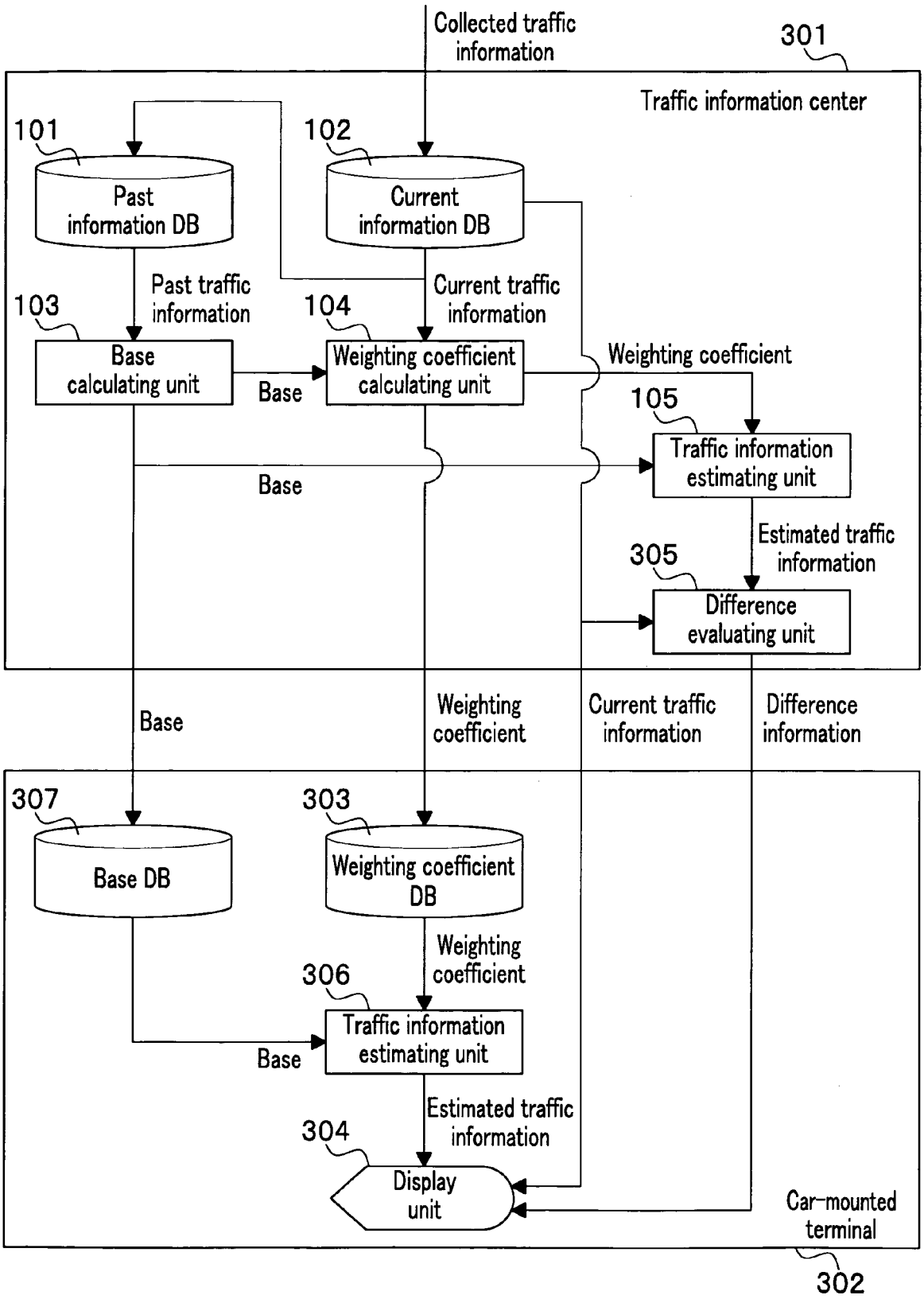
FIG. 3 is a block diagram of a traffic information system configured with a traffic information center for producing estimated traffic information based on probe traffic information and a in-vehicle terminal.

FIG. 3 is a block diagram showing a configuration in which functions of the traffic information system 100 in FIG. 1 are separately installed in a traffic information center 301 and a in-vehicle terminal 302 by dividing the functions. The traffic information center 301 includes the past information DB 101, the current information DB 102, the base calculating unit 103 and the weighting coefficient calculating unit 104 in FIG. 1, and delivers current probe traffic information, bases output from the base calculating unit 103, and weighting coefficients output from the weighting coefficient calculating unit 104 to the in-vehicle terminal 302. The in-vehicle terminal 302 includes a base DB 307 which stores the bases delivered from the traffic information center 301 and the weighting coefficients, a weighting coefficient DB 303, a traffic information estimating unit 306, and a display unit 304. The traffic information estimating unit 306 in the in-vehicle terminal 302 calculates the estimated traffic information based on the bases and weighting coefficients received from the traffic information center 301, and outputs it to the display unit 304. The display unit 304 displays the estimated traffic information of a link where the traffic information is missing by similar processing with that of the traffic information complementing unit 106 in FIG. 1. For this purpose, the display unit 304 reads out data of a road map for a display range from a map information database (not shown), and displays it on a screen. In addition, the display unit 304 displays the estimated traffic information of a link where the current probe traffic information is not collected by adding the information to the map screen, as well as the current probe traffic information.

Figure 4:
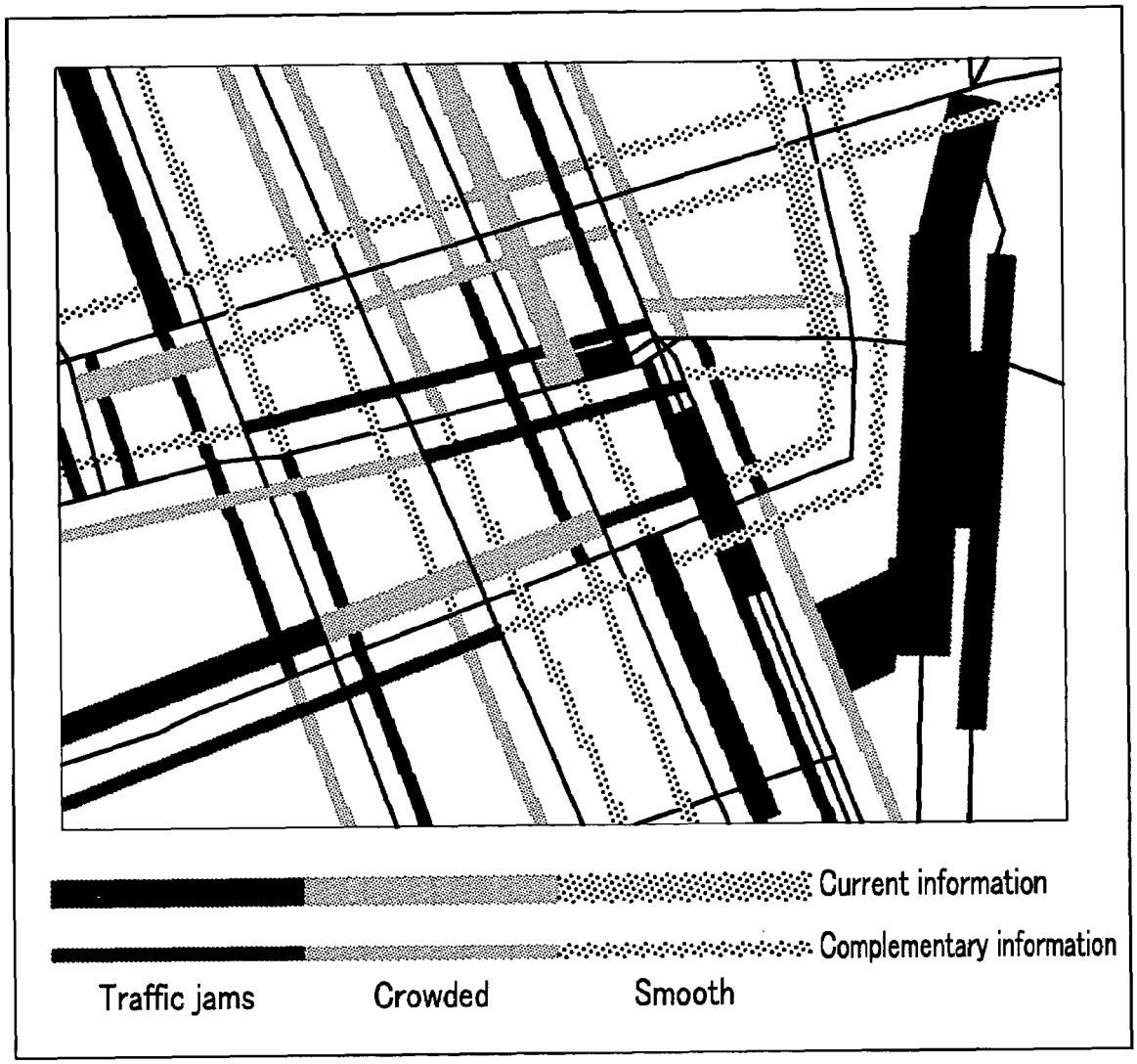
FIG. 4 is a display example of a in-vehicle terminal.
Figure 5:
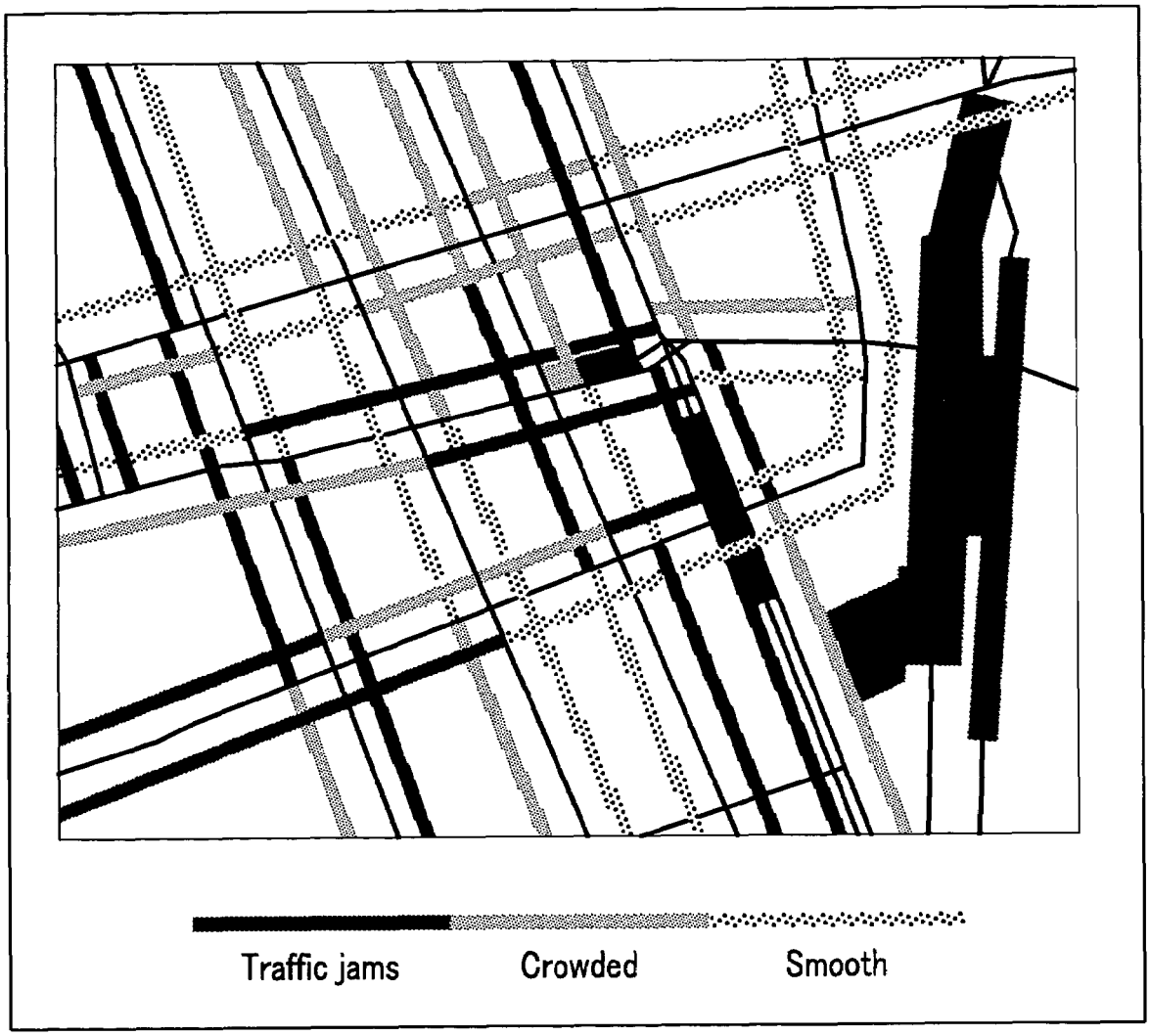
FIG. 5 is another display example of an in-vehicle terminal.

FIG. 4 is a display sample of the display unit 304. In the example, the current probe traffic information (current information) and the estimated traffic information (complementary information) are distinguished by a line thickness drawn along a road link, and displayed with different colors according to a degree of traffic jams for each road link. As a display method for distinguishing the current probe traffic information (current information) and the estimated traffic information (complementary information), the method is acceptable and not limited to the example in FIG. 4 if it can distinguish both displays of the current information and complementary information by, for example, changing a hue/chromaticness/brightness or a type of the line. On the other hand, FIG. 5 is another example displaying the current probe traffic information (current information) and the estimated traffic information (complementary information) without distinction. If the both displays are distinguished like in FIG. 4, there is a risk that a path of a probe car is identified by tracing a link displayed as the probe traffic information when the probe traffic information is few. However, if the both displays are displayed without distinction like in FIG. 5, discrimination of the current probe traffic information becomes difficult, thereby resulting in prevention from identifying a running path of a car which provides with the probe information.

A difference between the display sample shown in FIG. 5 and a screen display of a conventional traffic information display unit is as follows. In a conventional traffic information display unit, only a road link, where on-road sensors exist, and traffic information of the road link, where the probe traffic information is collected in real time, or the road link, where statistical traffic information based on the probe traffic information is prepared in advance, are displayed. On the other hand, in the display sample shown in FIG. 5, all road links can be displayed as display targets of the traffic information except a narrow bottleneck road which is not a providing target of the traffic information, by combining the current information and the estimated traffic information. In addition, in the display sample shown in FIG. 5, if the display unit only displays the estimated traffic information which is calculated by the traffic information estimating unit 105 for all road links without displaying any current probe traffic information, the in-vehicle terminal 302 does not need the current probe traffic information. In this case, the traffic information center 301 is not required to deliver the current probe traffic information at every timing, but required to deliver only the bases and the weighting coefficients. Accordingly, it is possible to decrease the risk that the path of each probe car is identified from the delivered current probe traffic information, as well as reducing a communication time and a communication data volume.

In the embodiment, the in-vehicle terminal 302 becomes capable of calculating the estimated traffic information by the traffic information estimating unit 105 after obtaining both data of the bases and the weighting coefficients from the traffic information center 301. Therefore, if any one of the bases and weighting coefficients are coded for delivery, and if only the in-vehicle terminal 302 of a specified user has a key for decoding a coded content, it is possible to apply the embodiment to a traffic information service which is limited to a club member. As a delivery method of the bases and weighting coefficients, the following method is possible. That is, for example, the bases which have a low update frequency are delivered with charge after coding via cellar phones or internet lines, and the weighting coefficients which are needed to be updated constantly in response to the current status are delivered via a broadcast type of media, such as a terrestrial digital broadcasting.

Meanwhile, a configuration which calculates the estimated traffic information with the bases and weighting coefficients as the embodiment has an advantage for delivering the traffic information with compression. That is, since the base is specific information to the link group and not changed frequently, a frequency, for example, one time per day, one time per week, or one time per month, of the base delivery may be sufficient. On the other hand, the weighting coefficient must be calculated and delivered by the weighting coefficient calculating unit 104 in response to the current probe traffic information. However, as described in the first embodiment, since information which does not change with time is collected into the base by applying the Principal Component Analysis to the calculation of the base, a data volume of the weighting coefficient is much smaller than that of the traffic information thereof. Accordingly, the in-vehicle terminal 302 can obtain approximated information of the current traffic information with a much less communication volume compared with the delivery of the traffic information as it is, by storing the base data in base DB 203 of the in-vehicle terminal in advance, by receiving only weighting coefficient data which is calculated in the traffic information center 301 in response to the current traffic information in real time at every update cycle, and by calculating the estimated traffic information with the traffic information estimating unit 105 on the in-vehicle terminal 302.

In addition, the traffic information can be delivered by compressing the data volume as well as suppressing an error caused by approximating the traffic information with the base and the weighting coefficient within a predetermined threshold value, by installing the traffic information estimating unit 105 again in the traffic information center 301 in FIG. 3, by calculating a difference between the current traffic information and the estimated traffic information calculated with the traffic information estimating unit 105 for each link, and by installing a difference evaluating unit 305 for delivering the current traffic information as it is, or information of the difference from the estimated traffic information instead of the current information to the in-vehicle terminal 302 with respect to only a link where the difference is larger than the predetermined threshold value. In this case, the display unit 304 of the in-vehicle terminal 302 displays the traffic information which is corrected by the information of the difference obtained from the estimated traffic information calculated in the in-vehicle terminal 302 instead of displaying the current traffic information. In addition, compression of the traffic information by using the base and the weighting coefficient is a specialized method to a property of the traffic information which varies with correlations among a plurality of road links, compared to a usual compression algorithm, and has an advantage of approximately reproducing the original traffic information with a small calculation volume by a product-sum operation of formula (9).

Fourth Embodiment

Figure 6:
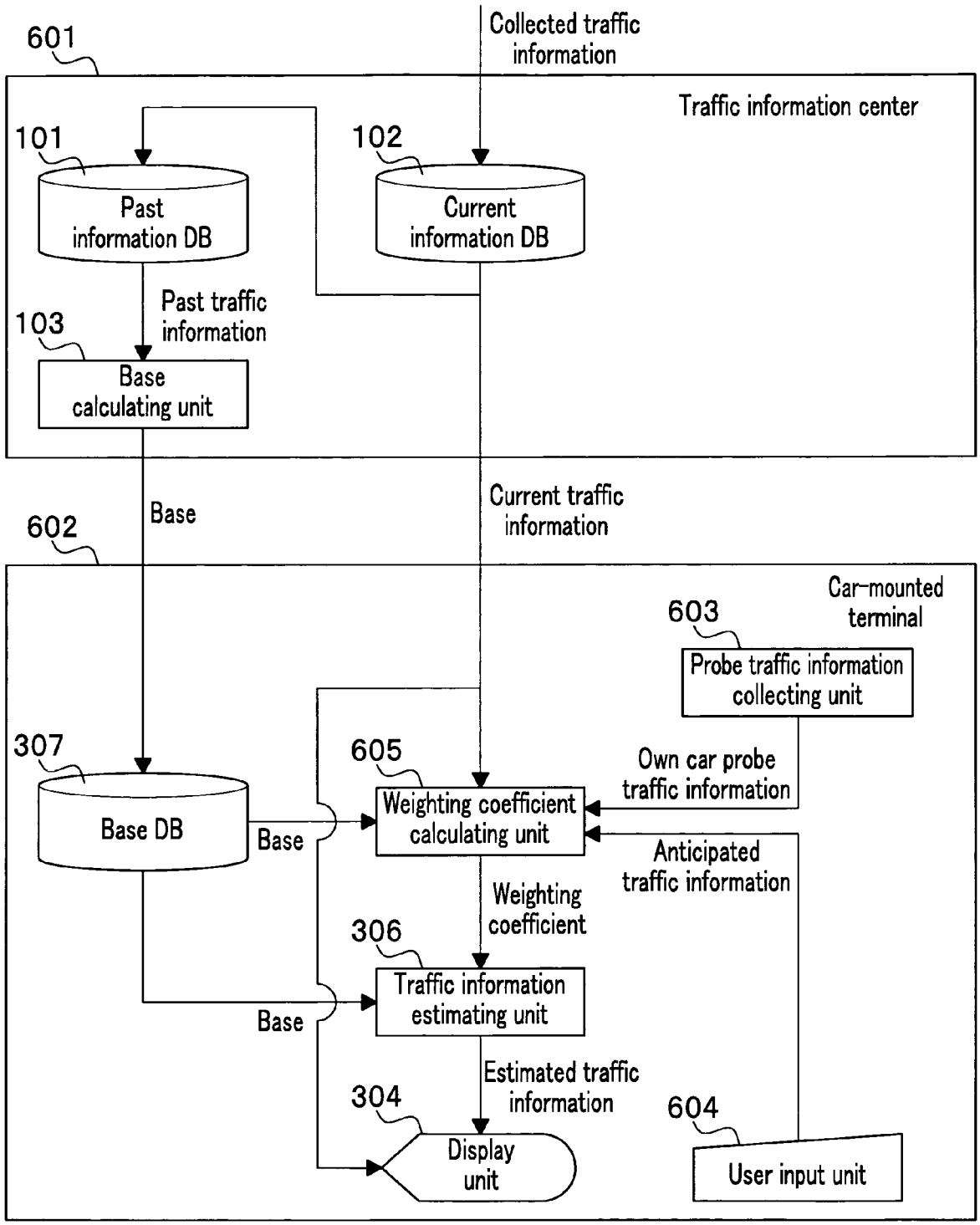
FIG. 6 is a block diagram of a traffic information system for calculating weighting coefficients on an in-vehicle terminal.

FIG. 6 is a block diagram of a configuration in which functions of the traffic information system 100 shown in FIG. 1 are divided and separately installed into a traffic information center 601 and an in-vehicle terminal 602 as with the third embodiment. A difference from the third embodiment is that a weighting coefficient calculating unit 605 is located in the in-vehicle terminal 602 instead of the traffic information center 601. That is, the traffic information center 601 includes the past information DB 101, the current information DB 102, and the base calculating unit 103 in FIG. 1, and delivers bases output from the base calculating unit 103 to the in-vehicle terminal 602, as well as delivering current probe traffic information, which is the traffic information collected and stored, as the current traffic information. The in-vehicle terminal 602 includes a base DB 307 which stores the bases delivered from the traffic information center 601, the weighting coefficient calculating unit 605, the traffic information estimating unit 306, and the display unit 304.

The in-vehicle terminal 602 calculates the weighting coefficient of the current traffic information with the weighting coefficient calculating unit 605 based on the bases delivered from the traffic information center 601 and the current traffic information. The traffic information estimating unit 306 calculates the estimated traffic information based on the weighting coefficients, and outputs the information to the display unit 304. The display unit 304 displays the estimated traffic information on a map screen as well as the current traffic information. This is the same with the third embodiment.

When the weighting coefficient is calculated at an in-vehicle terminal side as the embodiment, there is an advantage such that the estimated traffic information can be produced by determining the weighting coefficient using the probe traffic information which is independently collected with his/her own car, in addition to the common probe traffic information delivered from a traffic information center. That is, by installing the probe traffic information collecting unit 603 in the in-vehicle terminal 602, running information of a car, such as a running speed and a coordinate of the running position collected at a given time with the unit, is collected and input to the weighting coefficient calculating unit 605 as the probe traffic information collected by the own car, as well as the common probe traffic information delivered from the traffic information center. Here, the common probe traffic information and the own car probe traffic information correspond to Z and R in the formula (4) and the formula (10), respectively. Then, the weighting coefficient which reflects both the common probe traffic information and the own car probe traffic information is calculated by implementing the weighting projection to a linear space which is spanned with the bases W(1) to W(p) after merging the common probe traffic information and the own car probe traffic information as with formula (11) in the second embodiment. Accordingly, the estimated traffic information based on the weighting coefficient can be produced with the traffic information estimating unit 306, by using the calculated weighting coefficient and base received from the traffic information center 601. As described above, by using the own car probe traffic information as complementary information within the in-vehicle terminal 602, and based on correlations with traffic information of the road links where the own car has run, accuracy of the estimated traffic information in the vicinity of the road links can be improved without giving any private information such as a position and path of the own car to outside of the car.

In the embodiment, it is possible to give a simulation function of a traffic status to the in-vehicle terminal 602 by inputting anticipated traffic information, which is input by a user through a user input unit 604, instead of the own car probe traffic information to the weighting coefficient calculating unit 605. The user input unit 604 is, for example, a touch panel coupled with a map display on the display unit 304, or a remote-controlled pointing device, that is, an interface for inputting the traffic information which is anticipated by the user for a specific road link. The weighting coefficient calculating unit 605 determines the weighting coefficient based on the probe traffic information delivered from the traffic information center and the anticipated traffic information which is input by the user instead of the own car probe traffic information, and the traffic information estimating unit 306 calculates the estimated traffic information. As a result, when a specific traffic status that the user indicated has happened in a link, information of how the traffic statuses of road links in the vicinity of the link will be changed can be estimated based on the correlations among the road links, as well as reflecting the current probe traffic information.

INDUSTRIAL APPLICABILITY

When the probe traffic information is used for a traffic information service, the present invention can be used for providing with the estimated traffic information to a link where the probe traffic information was not collected. Especially, even if a missing percentage of the probe traffic information is high, it is possible to provide the estimated traffic information with high accuracy based on the correlations among the road links by using the present invention.

The preferred embodiments of the present invention have been explained. However, the present invention is not limited to the embodiments described above.

What is claimed is:

1. A traffic information estimating system, comprising:

a past information database for storing past information, which is collected with respect to any road links in a predetermined area;

a current information database for storing current traffic information with respect to any road links in the predetermined area;

base calculating means for calculating a plurality of bases each of which is correlation information for approximating traffic information of each of the road links in the predetermined area by a linear sum using a plurality of the correlation information among the road links based on the past information stored in the past information database, by using a principal component analysis with missing data;

a weighting coefficient calculating means for calculating a weighting coefficients of each of the bases for approximating the current traffic information which is stored in the current information database by linear sum of the bases; and a traffic information estimating means for calculating the estimated traffic information for a link where the current traffic information is lacking based on the bases calculated by the base calculating means and the weighting coefficient.

2. The traffic information estimating system according to claim 1, wherein the base calculating means configures the each base with components which vary with correlations among each link of the road links in the past information.

3. The traffic information estimating system according to claim 1, wherein the current information is measured at a predetermined time interval;

wherein the weighting coefficient calculating means determines the weighting coefficients of the bases, based on a weighting value depending on freshness of the current information.

4. The traffic information estimating system according to claim 1, wherein the weighting coefficient calculating means determines the weighting coefficients of the bases, based on a weighting value depending on a degree of a reliability of the current information.

5. The traffic information estimating system according to claim 1, wherein the weighting coefficient calculating means determines the weighting coefficients of the bases, based on a weighting value depending on a degree of a reliability of the current information, wherein the degree of the reliability of the current information is defined depending on a number of the mobile objects.

6. The traffic information estimating system according to claim 1, further comprising traffic information estimating means for calculating estimated traffic information which is produced by the linear sum of the bases by using the weighting coefficients as coefficients, wherein the estimated traffic information is output as complementary traffic information to a road link where the current information is not collected.

* * * * *